US008653735B2

(12) United States Patent
Wei et al.

(10) Patent No.: US 8,653,735 B2
(45) Date of Patent: Feb. 18, 2014

(54) BACKLIGHT MODULE OF LIQUID CRYSTAL DISPLAY DEVICE

(75) Inventors: Shih-Wen Wei, Hsin-Chu (TW); Tsung-Shiun Lee, Hsin-Chu (TW); Yun-Pei Huang, Hsin-Chu (TW); Chun-Liang Kuo, Hsin-Chu (TW)

(73) Assignee: AU Optronics Corp., Hsinchu (TW)

( * ) Notice: Subject to any disclaimer, the term of this patent is extended or adjusted under 35 U.S.C. 154(b) by 265 days.

(21) Appl. No.: 13/166,061

(22) Filed: Jun. 22, 2011

(65) Prior Publication Data

US 2012/0025712 A1 Feb. 2, 2012

(30) Foreign Application Priority Data

Aug. 2, 2010 (TW) ..... 99125593 A

(51) Int. Cl.
*H05B 41/36* (2006.01)

(52) U.S. Cl.
USPC ..... 315/121; 315/209 R; 315/291; 315/308; 315/312; 345/102

(58) Field of Classification Search
USPC ..... 315/119, 121, 209 R, 219, 276, 291, 315/307, 308, 312; 345/102
See application file for complete search history.

(56) References Cited

U.S. PATENT DOCUMENTS

| | | | | |
|---|---|---|---|---|
| 6,198,236 | B1 | 3/2001 | O'Neill et al. | |
| 7,394,212 | B2 * | 7/2008 | Wey et al. | 315/291 |
| 8,183,792 | B2 * | 5/2012 | Lin et al. | 315/291 |
| 2006/0043909 | A1 * | 3/2006 | Hwang et al. | 315/276 |
| 2007/0090774 | A1 * | 4/2007 | Ger et al. | 315/291 |
| 2008/0136343 | A1 * | 6/2008 | Yu et al. | 315/219 |
| 2010/0315005 | A1 | 12/2010 | Lin et al. | |

FOREIGN PATENT DOCUMENTS

| | | |
|---|---|---|
| CN | 101600285 | 12/2009 |
| TW | I280377 | 5/2007 |
| TW | 200832332 | 8/2008 |

* cited by examiner

*Primary Examiner* — Douglas W Owens
*Assistant Examiner* — Thai Pham
(74) *Attorney, Agent, or Firm* — WPAT, PC; Justin King

(57) ABSTRACT

The disclosure provides a backlight module applied to a liquid crystal display device. The backlight module includes: a control circuit for outputting a driving signal according to an analog adjustment signal or a digital adjustment signal; a driving circuit for outputting a lamp voltage according to the driving signal; a fluorescent lamp set, including a plurality of lamps, for receiving the lamp voltage and thereby generating a lamp current; a lamp feedback circuit c for outputting a feedback signal according to the lamp voltage; and a dynamic protection circuit, for dynamically adjusting a protection command signal according to the analog dimming signal or the digital dimming signal, comparing the protection command signal and the feedback signal and thereby outputting a comparing result signal to the control circuit.

10 Claims, 6 Drawing Sheets

BACKLIGHT MODULE OF LIQUID CRYSTAL DISPLAY DEVICE

BACKGROUND

1. Technical Field

The present invention relates to a backlight module circuit of a liquid crystal display device, and more particularly to a backlight module protection circuit of a liquid crystal display device.

2. Description of the Related Art

In recent years, cold cathode fluorescent lamps (CCFLs), functioning as light sources of backlight modules, are commonly applied to TFT-LCD devices. For increasing the image quality and display effect of the TFT-LCD devices, how to dynamically adjust light source luminance of the CCFLs is a main research scope in the related TFT-LCD display field.

Moreover, in order to meet the requirements of energy savings, high dynamic contrast ratio (DCR) and dynamic display, the light source of the backlight module is expected to perform a real-time luminance adjustment to achieve higher image display quality. In this situation, a current flowing through the cold cathode fluorescent lamps is dynamically changed. Because of the real-time luminance adjustment, when an abnormal situation occurs on the cold cathode fluorescent lamps such as being collided or fallen off, which would result in the cold cathode fluorescent lamps being open circuit. If a protection circuit of the backlight module could not effectively and rightly perform protection function, which would endanger personnel safety and cause operation error of the liquid crystal display device.

Of course, the luminance adjustment of the backlight module may be manually performed by an user in response to an operation environment where the user located in, or automatically performed triggered by a light sensor in the liquid crystal display device sensing the operation environmental luminance.

FIG. 1 is a schematic block diagram of a conventional backlight module using cold cathode fluorescent lamps as a light source thereof. The backlight module 10 includes a control circuit 12, a driving circuit 14, a lamp feedback circuit 16, a protection circuit 18, and a fluorescent lamp set 20 having multiple fluorescent lamps 202. The fluorescent lamp set 20 acts as the light source of the backlight module 10. The protection circuit 18 is comprised of a comparator 182.

Since the conventional protection circuit 18 uses a protection command signal V-command with a fixed value, when the fluorescent lamp set 20 produces a low luminance and further is abnormal or even open circuit, the protection circuit 18 might not be able to detect the abnormal situation in real-time, resulting in the occurrence of issues such as endangering personnel safety and operation error of the liquid crystal display device. Operation principles of signals in the backlight module 10 will be described below in detail.

FIG. 2A is a schematic view of a feedback signal V-fb and the protection command signal V-command when the fluorescent lamp set 20 is abnormal in all-ON state. As illustrated in FIG. 2A, an analog dimming signal A-dim is set at a maximum value, or a duty cycle of a digital dimming signal is set at 100%, so that an amplitude of a lamp current Ilamp is adjusted to be at a maximum value and the fluorescent lamp set 20 is maintained at the all-ON state.

It is clear that, when the fluorescent lamp set 20 is abnormal or even a lamp(s) thereof is/are open circuit, since a momentary load of the fluorescent lamp set 20 is decreased, which causes the lamp voltage Vlamp is increased correspondingly. In this moment, after the lamp feedback circuit 16 obtains the lamp voltage Vlamp and then converted the obtained lamp voltage Vlamp into the feedback signal V-fb, the feedback signal V-fb would be higher than the protection command signal V-command. Accordingly, the protection circuit 18 outputs a low level of comparing result signal Vp, to enable the control circuit 12 to turn off the fluorescent lamp set 20 and thereby achieving the purpose of protecting the fluorescent lamp set 20.

FIG. 2B is a schematic view of the feedback signal V-fb and the protection command signal V-command when the fluorescent lamp set 20 is abnormal during analog dimming. As illustrated in FIG. 2B, the purpose of decreasing the lamp voltage Vlamp and the lamp current Ilamp can be achieved by decreasing the analog dimming signal A-dim.

It is clear that, during the analog dimming, the lamp voltage Vlamp is relatively low, in this situation, even if the fluorescent lamp set 20 is abnormal or even a lamp(s) thereof is/are open circuit, an increase of amplitude for the lamp voltage Vlamp is limited. After the lamp feedback circuit 16 obtains the lamp voltage Vlamp and then converted the obtained lamp voltage Vlamp into the feedback signal V-fb, the feedback signal V-fb may be still lower than the protection command signal V-command. Accordingly, the protection circuit 18 outputs a high level of comparing result signal Vp, to enable the control circuit 12 still to normally work and thereby resulting in the damage of the fluorescent lamp set 20.

FIG. 2C is a schematic view of the feedback signal V-fb and the protection command signal V-command when the fluorescent lamp set 20 is abnormal during digital dimming. As illustrated in FIG. 2C, the purpose of decreasing a root-mean-square value of the lamp current Ilamp can be achieved by decreasing a digital dimming signal V-dim.

Likewise, during the digital dimming, an effective value of the lamp voltage Vlamp is relatively low, in this situation, even if the fluorescent lamp set 20 is abnormal or even a lamp(s) thereof is/are open circuit, an increase of amplitude for the lamp voltage Vlamp is limited. After the lamp feedback circuit 16 obtains the lamp voltage Vlamp and then converted the obtained lamp voltage Vlamp into the feedback signal V-fb, the feedback signal V-fb may be still lower than the protection command signal V-command. Accordingly, the protection circuit 18 outputs a high level of comparing result signal Vp, to enable the control circuit 12 still to normally work and thereby resulting in the damage of the fluorescent lamp set 20.

In summary, since the protection circuit 18 of the conventional backlight module 10 uses the protection command voltage V-command with the fixed value, once it is needed to achieve higher image display quality by decreasing the root-mean-square value of the lamp current Ilamp using the analog dimming or digital dimming, the lamp voltage Vlamp and the feedback signal V-fb would be decreased correspondingly. Therefore, once the fluorescent lamp set 20 becomes abnormal, the feedback signal V-fb may be still lower than the protection command signal V-command, so that the protection circuit 18 would wrongly judge that the multiple fluorescent lamps 202 still are normally working and thereby outputs the high level of comparing result signal Vp, which could not activate the protection mechanism of the backlight module 10.

SUMMARY

The present invention is related to a backlight module of a liquid crystal display device, which can dynamically adjust a protection command signal according to an analog dimming signal or a digital dimming signal and thereby can detect the abnormal situation in real-time and rightly turn off the fluorescent lamp set.

More specifically, a backlight module in accordance with an embodiment of the present invention is applied to a liquid crystal display device. The backlight module includes: a control circuit, a driving circuit, a fluorescent lamp set, a lamp feedback circuit and a dynamic protection circuit. The control circuit is for outputting a driving signal according to an analog dimming signal or a digital dimming signal. The driving circuit is electrically coupled to the control circuit and for receiving the driving signal and thereby outputting a lamp voltage according to the received driving signal. The fluorescent lamp set is electrically coupled to the driving circuit and includes a plurality of lamps and further is for receiving the lamp voltage and thereby producing a lamp current. The lamp feedback circuit is electrically coupled to the driving circuit and for obtaining the lamp voltage and thereby outputting a feedback signal according to the obtained lamp voltage. The dynamic protection circuit is electrically coupled between the lamp feedback circuit and the control circuit. The dynamic protection circuit further is for dynamically adjusting a protection command signal according to the analog dimming signal or the digital dimming signal, comparing the protection command signal and the feedback signal and thereby outputting a comparing result signal to the control circuit.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. Accordingly, the descriptions will be regarded as illustrative in nature and not as restrictive.

According to an embodiment of the present invention, a backlight module is configured with a dynamic protection circuit. In such dynamic protection circuit, a protection command signal V-command is used can be dynamically adjusted along the change of an analog dimming signal A-dim or a digital dimming signal V-dim.

Figure 1:
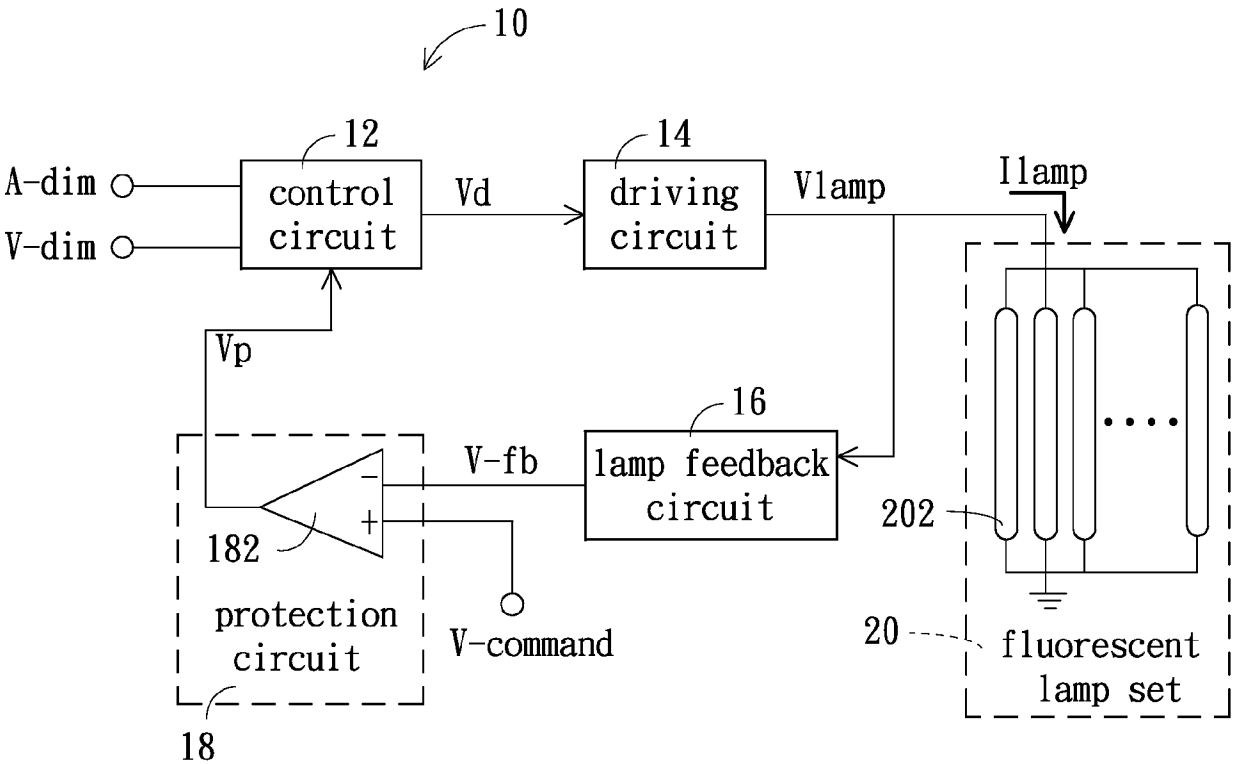
FIG. 1(Related Art)
FIG. 1 is a schematic block diagram of a conventional backlight module using cold cathode fluorescent lamps as a light source thereof.
Figure 2A:
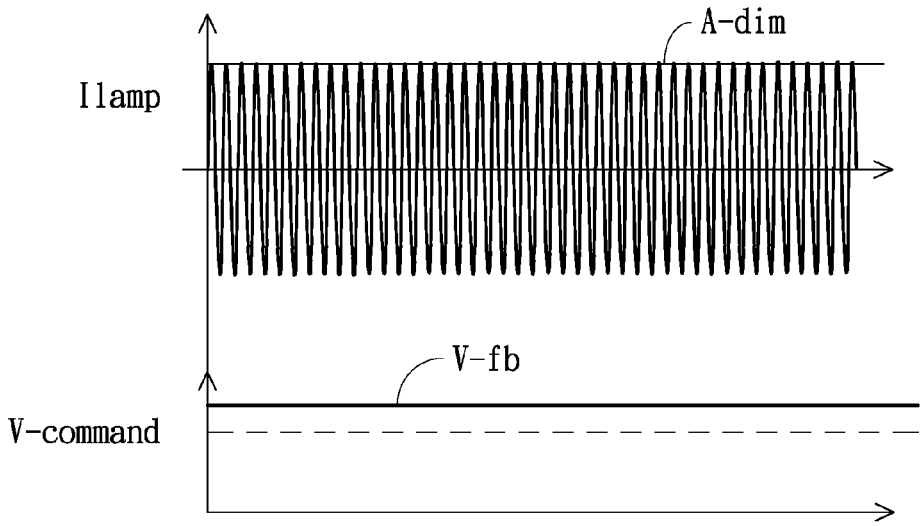
FIG. 2A(Related Art)
FIG. 2A is a schematic view of a feedback signal V-fb and a protection command signal V-command when the fluorescent lamp set in FIG. 1 is abnormal in all-ON state.
Figure 2B:
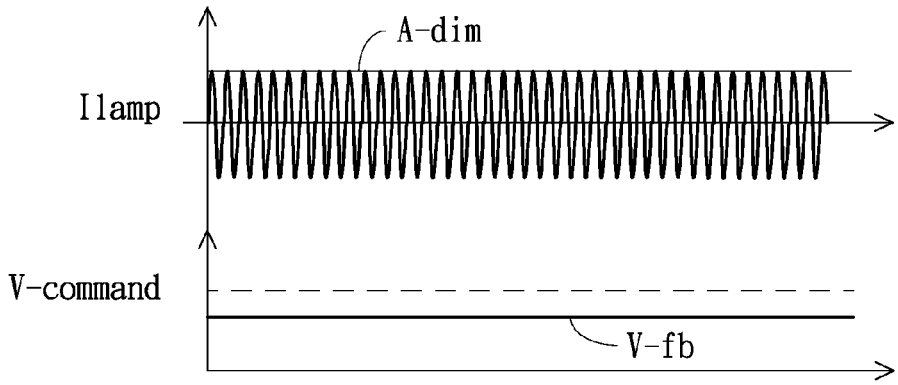
FIG. 2B(Related Art)
FIG. 2B is a schematic view of a feedback signal V-fb and a protection command signal V-command when the fluorescent lamp set in FIG. 1 is abnormal during analog dimming.
Figure 2C:
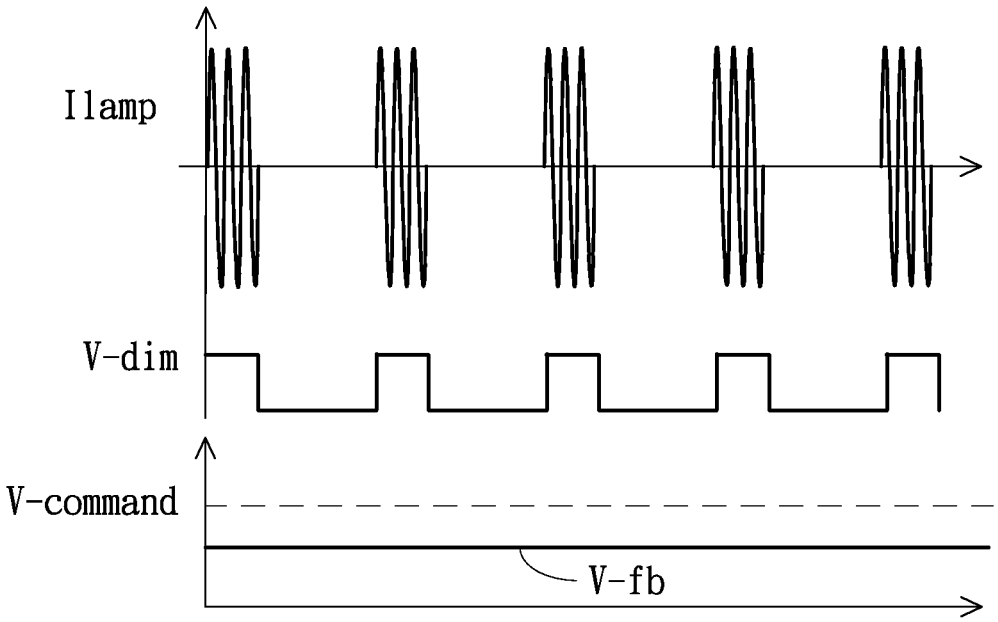
FIG. 2C(Related Art)
FIG. 2C is a schematic view of a feedback signal V-fb and a protection command signal V-command when the fluorescent lamp set in FIG. 1 is abnormal during digital dimming.
Figure 3:
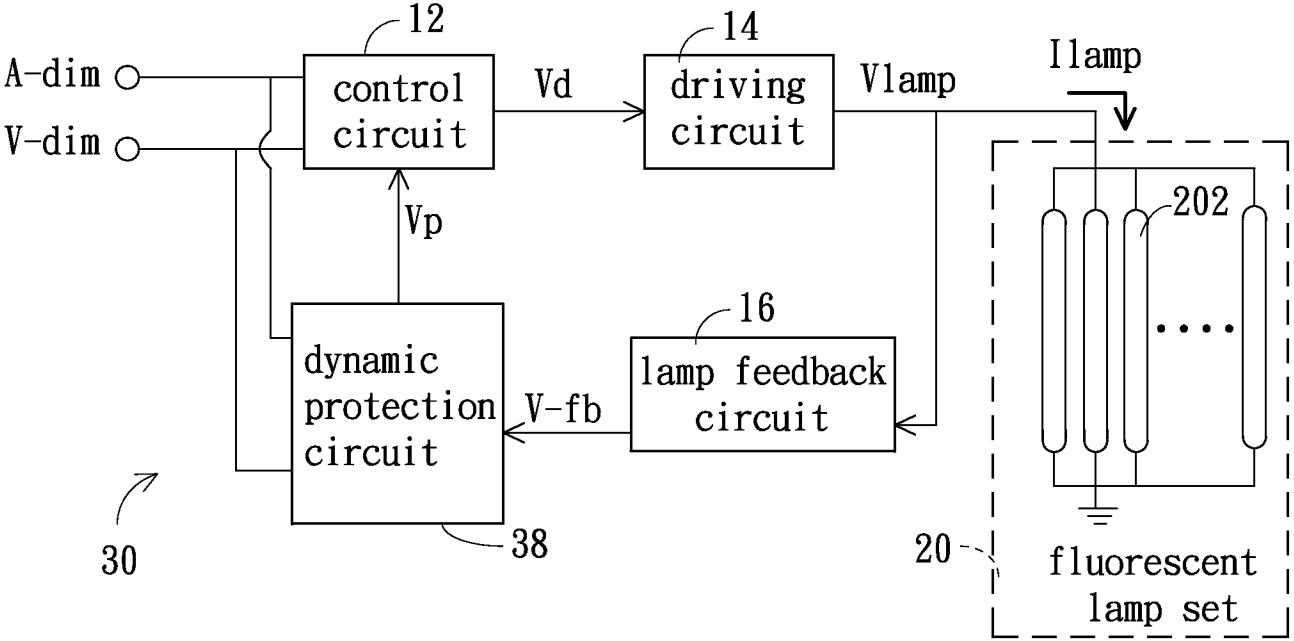
FIG. 3 is a schematic block diagram of a backlight module of a liquid crystal display device equipped with dynamic protection circuit in accordance with an embodiment of the present invention.

Please refer to FIG. 3, a schematic block diagram of a backlight module of a liquid crystal display device with a dynamic protection circuit in accordance with an embodiment of the present invention is depicted. The backlight module 30 includes a control circuit 12, a driving circuit 14, a lamp feedback circuit 16, a protection circuit 38, and a fluorescent lamp set 20.

As depicted in FIG. 3, the control circuit 12 outputs a driving signal Vd to the driving circuit 14 according to an analog dimming signal A-dim or a digital dimming signal V-dim. The driving signal Vd primarily is for providing a driving voltage for a power MOS (not shown) in the driving circuit 14. The driving circuit 14 can include a full-wave rectifier or a half-wave rectifier, or other type of rectifier for converting a direct current signal into an alternating current signal. That is, the driving circuit 14 can outputs an alternating current type lamp voltage Vlamp according to a received direct current type driving signal Vd.

After the lamp voltage Vlamp is inputed into the fluorescent lamp set 20, the fluorescent lamp set 20 would produce a lamp current Ilamp. Such lamp current Ilamp will flow through the multiple fluorescent lamps 202 in the fluorescent lamp set 20, so that the fluorescent lamps 202 can produce a luminance. Moreover, the lamp current Ilamp is a since wave signal, and the luminance produced by the fluorescent lamps 202 is relevant to a root-mean-square value of the lamp current Ilamp. That is, the larger of the root-mean-square value of the lamp current Ilamp flowing through the fluorescent lamps 202, the higher of the luminance produced by the fluorescent lamps 202.

Furthermore, the backlight module 30 in accordance with the present invention also is endowed with a protection mechanism. A primary intended use of the protection mechanism is that: when the fluorescent lamp set 20 is detected out being abnormal or even a lamp(s) therefore being open circuit, it can enable the control circuit 12 to turn off the fluorescent lamp set 20 in real-time. In particular, the protection mechanism in accordance with the present invention primarily is achieved by the lamp feedback circuit 16 and the protection circuit 18. As illustrated in FIG. 3, the lamp feedback circuit 16 is electrically coupled to the driving circuit 14 and for receiving the lamp voltage Vlamp. The lamp feedback circuit 16 can be comprised of one or multiple resistors, one or multiple capacitors and one or multiple diodes. The lamp feedback circuit 16 receives a full-wave signal of the lamp voltage V-lamp of the fluorescent lamp set 20 and outputs a direct current type feedback signal V-fb after performing rectifying and filtering operations.

As illustrated in FIG. 3, the dynamic protection circuit 38 is electrically coupled between the lamp feedback circuit 16 and the control circuit 12. The feedback signal V-fb outputted from the lamp feedback circuit 16 is inputted into the dynamic protection circuit 38. In such dynamic protection circuit 38, the feedback signal V-fb and a protection command signal V-command are compared to generate a comparing result signal Vp as a criteria of whether triggering the protection mechanism.

In addition, as illustrated in FIG. 3, there are two approaches to adjust the luminance of the backlight module 30. In particular, approach (I) is that: using the analog dimming signal A-dim to directly adjust the amplitude of the lamp voltage Vlamp. When the amplitude of the lamp voltage Vlamp increases, direct current level amplitude and root-mean-square value of the lamp current Ilamp are increased correspondingly, the fluorescent lamp set 20 would produce a relatively high luminance. Likewise, when the amplitude of the lamp voltage Vlamp decreases, the direct current level amplitude and root-mean-square value of the lamp current Ilamp are decreased correspondingly, the fluorescent lamp set 20 would produce a relatively low luminance. Such approach (I) generally is termed as analog dimming.

Approach (II) is that using the digital dimming signal V-dim to adjust the lamp voltage Vlamp. That is, on the prerequisite of the lamp voltage Vlamp being unchanged, using the digital dimming signal V-dim, which is a pulse width modulation (PWM) signal, to adjust a time of the lamp voltage Vlamp supplied to the fluorescent lamp set 20 and thereby adjusting the root-mean-square value of the lamp current Ilamp. When the time of the lamp voltage Vlamp supplied to the fluorescent lamp set 20 is relatively long (i.e., generally a pulse width of the PWM signal is relatively wide), the root-mean-square value of the lamp current Ilamp is relatively large, and the fluorescent lamp set 20 would produce a relatively high luminance correspondingly. Whereas, when the time of the lamp voltage Vlamp supplied to the fluorescent lamp set 20 is relatively short (i.e., generally a pulse width of the PWM signal is relatively narrow), the root-mean-square value of the lamp current Ilamp is relatively small, and the fluorescent lamp set 20 would produce a relatively low luminance correspondingly. Such approach (II) generally is termed as digital dimming.

Of course, the luminance adjustment of the backlight module in the liquid crystal display device in accordance with the present invention is not limited to use the analog dimming signal A-dim and the digital dimming signal V-dim at the same time. Generally speaking, as long as the liquid crystal display device can output one of the analog dimming signal A-dim and the digital dimming signal V-dim in response to an operation of user or an automatic detection result of a light sensor, the luminance adjustment of the backlight module 30 can be achieved.

According to an embodiment of the present invention, a direct current level of the protection command signal V-command in the dynamic protection circuit 38 can be dynamically adjusted according to the luminance produced by the fluorescent lamp set 20. In other words, the dynamic protection circuit 38 receives the analog dimming signal A-dim and the digital dimming signal V-dim and thereby adjusting the direct current level of the protection command signal V-command. Moreover, regardless of the backlight module whether performing the backlight luminance adjustment, the dynamic protection circuit 38 would compare the protection command signal V-command with the feedback signal V-fb and thereby output a correct comparing result signal Vp. That is, when the feedback signal V-fb is lower than the protection command signal V-command, the dynamic protection circuit 38 outputs a high level of comparing result signal Vp and thus the backlight module continue to normally work. Whereas, when the feedback signal V-fb is higher than the protection command signal V-command, the dynamic protection circuit 38 would output a low level of comparing result signal Vp and thus the control circuit 12 is enabled to turn off the fluorescent lamp set 20.

Figure 4:
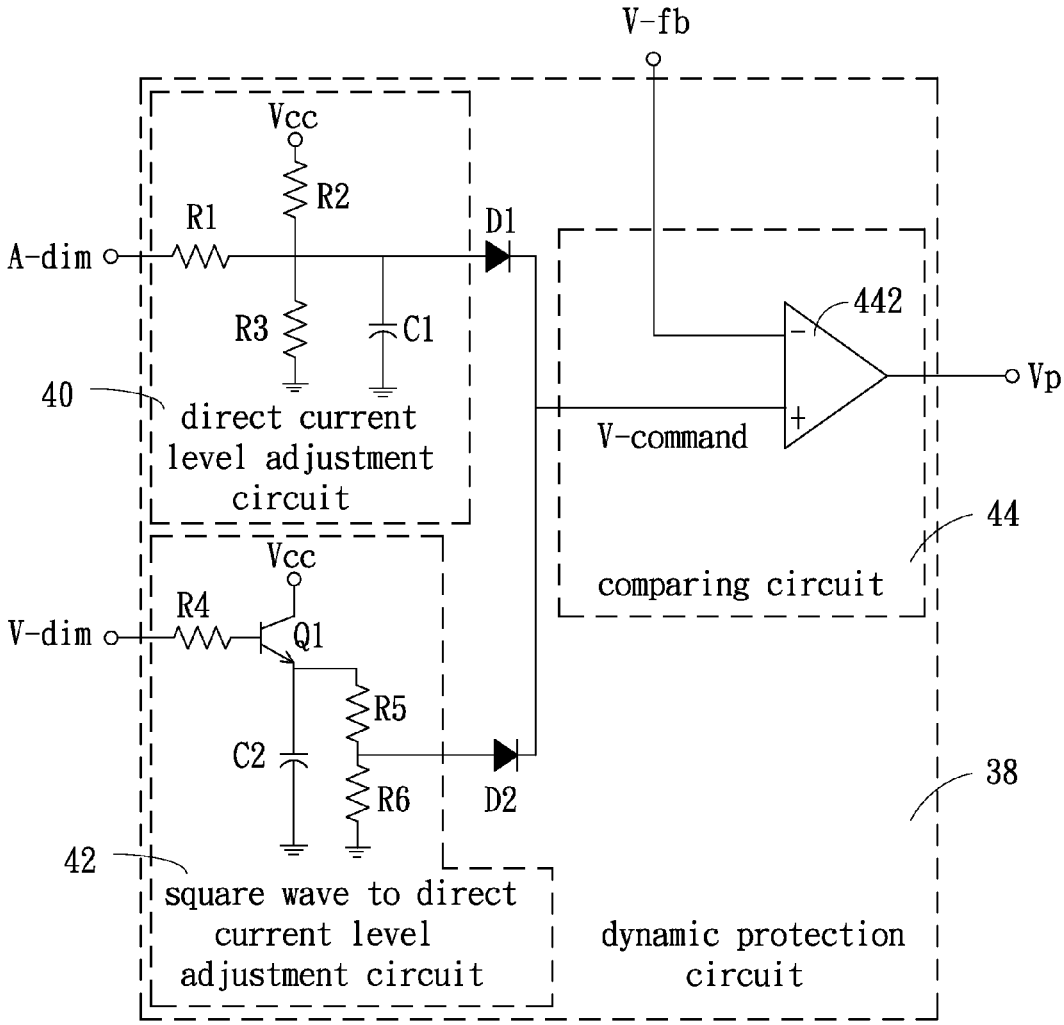
FIG. 4 is a schematic circuit diagram of the dynamic protection circuit in FIG. 3.

FIG. 4 is a schematic circuit diagram of the dynamic protection circuit 38 in accordance with an embodiment of the present invention. In particular, the dynamic protection circuit 38 includes a direct current level adjustment circuit 40, a square wave to direct current level adjustment circuit 42 and a comparing circuit 44.

The direct current level adjustment circuit 40 includes a first resistor R1, a second resistor R2, a third resistor R3 and a first capacitor C1. A first terminal of the first resistor R1 is electrically coupled to receive the analog dimming signal A-dim. A first terminal of the second resistor R2 is electrically coupled to a positive power source terminal Vcc. A first terminal of the third resistor R3 is electrically coupled to a ground terminal (i.e., is grounded). A first terminal of the first capacitor C1 is grounded. Second terminals of the first resistor R1, second resistor R2, third resistor R3 and first capacitor C1 are electrically coupled together and further electrically coupled to an anode terminal of a first diode D1.

Moreover, the square wave to direct current adjustment circuit 42 includes a fourth resistor R4, a fifth resistor R5, a sixth resistor R6, a first transistor Q1 and a second capacitor C2. A first terminal of the fourth resistor R4 is electrically coupled to receive the digital dimming signal V-dim. A base terminal of the first transistor Q1 is electrically coupled to a second terminal of the fourth resistor R4, a collector terminal of the first transistor Q1 is electrically coupled to the positive power source terminal Vcc, and an emitter terminal of the first transistor Q1 is electrically coupled to a first terminal of the second capacitor C2. A second terminal of the second capacitor C2 is grounded. A first terminal of the fifth resistor R5 is electrically coupled to the emitter terminal of the first transistor Q1. A first terminal of the sixth resistor R6 is grounded. Second terminals of the fifth resistor R5 and sixth resistor R6 are electrically coupled together and further electrically coupled to an anode terminal of a second diode D2.

In addition, the comparing circuit 44 includes a comparator 442. A negative input terminal (−) of the comparator 442 is electrically coupled to receive the feedback signal V-fb, a positive input terminal (+) of the comparator 442 is electrically coupled to cathode terminals of the first diode D1 and second diode D2, and an output terminal of the comparator 442 produces the comparing result signal Vp.

According to an embodiment of the present invention, the dynamic protection circuit 38 includes the direct current level adjustment circuit 40 and the square wave to direct current level adjustment circuit 42. However, if the liquid crystal display device uses the analog dimming signal A-dim to perform the luminance adjustment of backlight module, the output terminal of the direct current level adjustment circuit 40 is directly coupled to the positive input terminal (+) of the comparator 442, while the square wave to direct current level adjustment circuit 42, the first diode D1 and the second diode D2 can be omitted (i.e., without being configured). Likewise, if the liquid crystal display device uses the digital dimming signal V-dim to perform the luminance adjustment of backlight module, the output terminal of the square wave to direct current level adjustment circuit 42 is directly coupled to the positive input terminal (+) of the comparator 442, while the direct current level adjustment circuit 40, the first diode D1 and the second diode D2 can be omitted.

According to an embodiment of the present invention, it is assumed that the liquid crystal display device uses the analog dimming signal A-dim to perform a luminance adjustment of backlight module, the output terminal of the direct current level adjustment circuit 40 can produce the protection command signal V-command, while the square wave to direct current level adjustment circuit 42 would not receive the digital dimming signal V-dim. Therefore, $$V-\text{command}=\left(\frac{A-dim}{R1}+\frac{Vcc}{R2}\right)\times(R1\,//\,R2\,//\,R3).$$

That is, the higher of the voltage level of the analog dimming signal A-dim, the higher of the protection command signal V-command. Whereas, the lower of the voltage level of the analog dimming signal A-dim, the lower of the protection command signal V-command.

According to an embodiment of the present invention, it is assumed that the liquid crystal display device uses the digital dimming signal V-dim to perform a luminance adjustment of backlight module, the output terminal of the square wave to direct current level adjustment circuit 42 can produce the protection command signal V-command, while the direct current level adjustment circuit 40 would not receive the analog dimming signal A-dim. It is clear that, the wider of the pulse width of the digital dimming signal V-dim, the longer of the turn-on time of the first transistor Q1, the second capacitor C2 can be charged to a relatively high voltage level, so that the protection command signal V-command is relatively high. Whereas, the narrower of the pulse width of the digital dimming signal V-dim, the shorter of the turn-on time of the first transistor Q1, the second capacitor C2 only can be charged to a relatively low voltage level, so that the protection command signal V-command is relatively low.

Figure 5A:
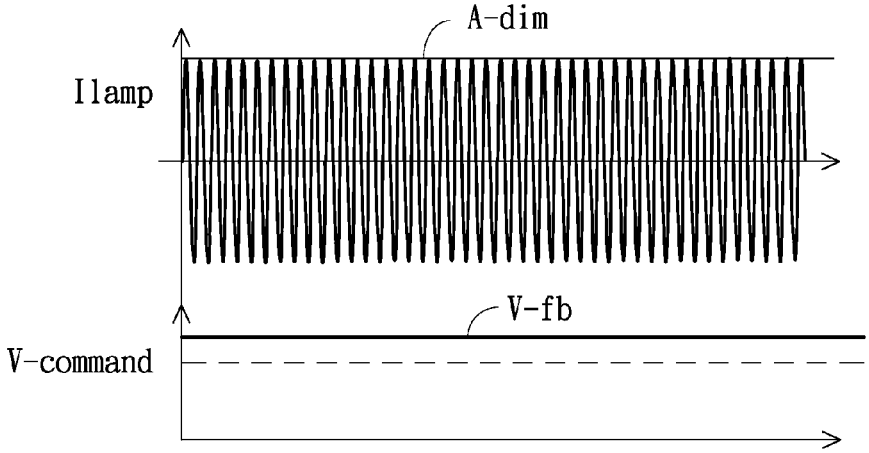
FIG. 5A is a schematic view of a feedback signal V-fb and a protection command signal V-command when the fluorescent lamp set in FIG. 3 is abnormal in all-ON state.

FIG. 5A is a schematic view of the feedback signal V-fb and the protection command signal V-command when the fluorescent lamp set 20 is abnormal in all-ON state. The analog dimming signal A-dim is set to a maximum value, or a duty cycle of the digital dimming signal V-dim is set as 100%, so that the amplitude of the lamp current Ilamp is up to a maximum value and the fluorescent lamp set 20 is maintained at the all-ON state.

It is clear that, when the when the fluorescent lamp set 20 is abnormal or even a lamp(s) thereof is/are open circuit, since a momentary load of the fluorescent lamp set 20 is decreased, which causes the lamp voltage Vlamp is increased correspondingly. In this moment, after the lamp feedback circuit 16 obtains the lamp voltage Vlamp and then converted the obtained lamp voltage Vlamp into the feedback signal V-fb, the feedback signal V-fb would be higher than the protection command signal V-command. Accordingly, the dynamic protection circuit 38 outputs a low level of comparing result signal Vp, to enable the control circuit 12 to turn off the fluorescent lamp set 20 and thereby achieving the purpose of protecting the fluorescent lamp set 20.

Figure 5B:
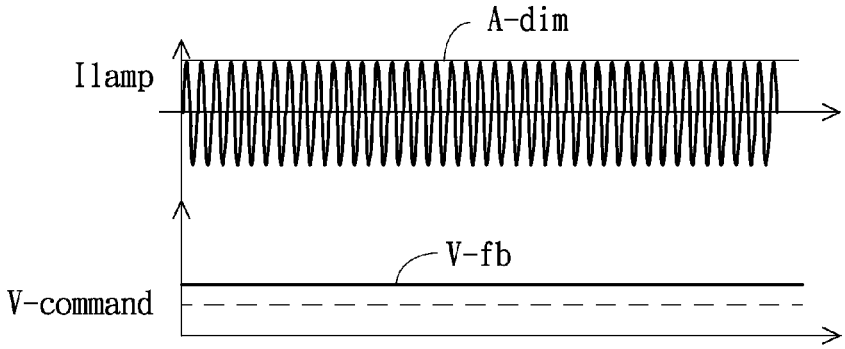
FIG. 5B is a schematic view of a feedback signal V-fb and a protection command signal V-command when the fluorescent lamp set in FIG. 1 is abnormal during analog dimming.

FIG. 5B is a schematic view of the feedback signal V-fb and the protection command signal V-command when the fluorescent lamp set 20 is abnormal during analog dimming. As illustrated in FIG. 5B, the purpose of decreasing the lamp voltage Vlamp and the lamp current Ilamp can be achieved by decreasing the analog dimming signal A-dim.

It is clear that, during the analog dimming, the lamp voltage Vlamp is relatively low. Since the direct current level adjustment circuit 40 has decreased the protection command signal V-command, if the fluorescent lamp set 20 is abnormal or even a lamp(s) thereof is/are open circuit, the feedback signal V-fb would still be higher than the protection command signal V-command. Accordingly, the dynamic protection circuit 38 outputs a low level of comparing result signal Vp, to enable the control circuit 12 to turn off the fluorescent lamp set 20 and thereby achieving the purpose of protecting the fluorescent lamp set 20.

Figure 5C:
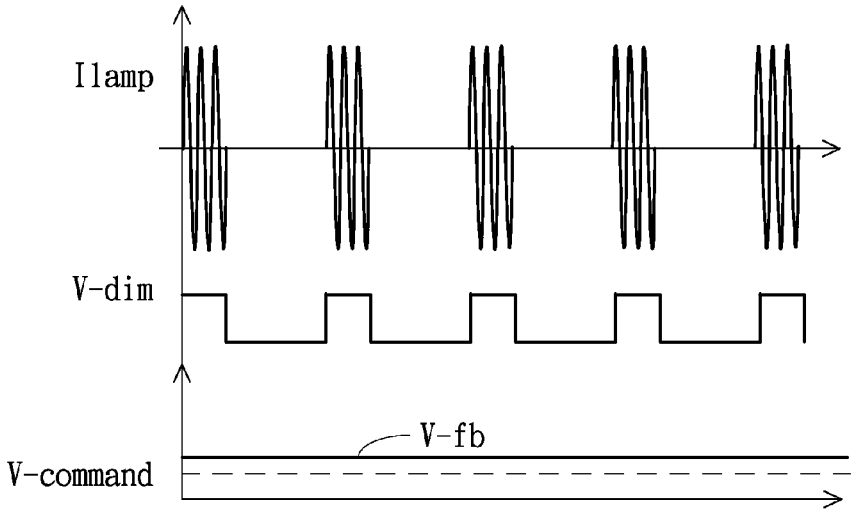
FIG. 5C is a schematic view of a feedback signal V-fb and a protection command signal V-command when the fluorescent lamp set in FIG. 1 is abnormal during digital dimming.

FIG. 5C is a schematic view of the feedback signal V-fb and the protection command signal V-command when the fluorescent lamp set 20 is abnormal during digital dimming. As illustrated in FIG. 5C, the purpose of decreasing a root-mean-square value of the lamp current Ilamp can be achieved by decreasing a digital dimming signal V-dim.

It is clear that, during the digital dimming, the lamp voltage Vlamp is relatively low. Since the square wave to direct current level adjustment circuit 42 has decreased the protection command signal V-command, if the fluorescent lamp set 20 is abnormal or even a lamp(s) thereof is/are open circuit, the feedback signal V-fb may be still higher than the protection command signal V-command. Accordingly, the dynamic protection circuit 38 outputs a high level of comparing result signal Vp, to enable the control circuit 12 to turn off the fluorescent lamp set 20 and thereby achieving the purpose of protecting the fluorescent lamp set 20.

In summary, the backlight module 30 in accordance with the present invention uses the dynamic protection circuit 38, which can dynamically adjust the protection command signal V-command in real-time according to the analog dimming signal A-dim or th digital dimming signal V-dim, and consequently can trigger the protection mechanism in time.

Additionally, the backlight module 30 in accordance with the present invention although use the cold cathode fluorescent lamps as an example, it is not to limit the present invention. The dynamic protection circuit 38 adopted by the backlight module 30 in accordance with the present invention also can be applied to other backlight module using external electrode fluorescent lamps (EEFLs), hot cathode fluorescent lamps (HCFLs), and so on.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A backlight module applied to a liquid crystal display device, the back light module comprising:

a control circuit for outputting a driving signal according to an analog dimming signal or a digital dimming signal;

a driving circuit, electrically coupled to the control circuit, for receiving the driving signal and thereby outputting a lamp voltage according to the received driving signal;

a fluorescent lamp set, electrically coupled to the driving circuit and comprising a plurality of fluorescent lamps, for receiving the lamp voltage and thereby producing a lamp current;

a lamp feedback circuit, electrically coupled to the driving circuit, for obtaining the lamp voltage and outputting a feedback signal according to the obtained lamp voltage; and a dynamic protection circuit, electrically coupled between the lamp feedback circuit and the control circuit, for dynamically adjusting a protection command signal according to the analog dimming signal or the digital dimming signal, comparing the protection command signal and the feedback signal, and thereby generating a comparing result signal to the control circuit, wherein, the dynamic protection circuit comprises:

a direct current level adjustment circuit, for receiving the analog dimming signal and thereby adjusting the protection command signal; and a comparing circuit, electrically coupled to the direct current level adjustment circuit, for receiving the adjusted protection command signal and the feedback signal and thereby outputting the comparing result signal.

2. The backlight module according to claim 1, wherein when the protection command signal is lower than the feedback signal, a first level of the comparing result signal informs the control circuit to turn off the fluorescent lamp set.

3. The backlight module according to claim 1, wherein when the protection command signal is higher than the feedback signal, a second level of the comparing result signal informs the control circuit to keep outputting the driving signal.

4. The backlight module according to claim 1, wherein the control circuit outputs the driving signal, according to the analog dimming signal or the digital dimming signal, to perform a dimming operation applied to the fluorescent lamp set.

5. The backlight module according to claim 1, wherein the direct current level adjustment circuit comprises:

a first resistor, wherein a first terminal of the first resistor is electrically coupled to receive the analog dimming signal;

a second resistor, wherein a first terminal of the second resistor is electrically coupled to a positive power source terminal;

a third resistor, wherein a first terminal of the third resistor is electrically coupled to a ground terminal; and a first capacitor, wherein a first terminal of the first capacitor is electrically coupled to the ground terminal;

wherein a second terminal of the first resistor, a second terminal of the second resistor, a second terminal of the third resistor and a second terminal of the first capacitor are electrically coupled together for outputting the adjusted protection command signal.

6. The backlight circuit according to claim 1, wherein the comparing circuit comprises a comparator, a negative input terminal of the comparator being electrically coupled to receive the feedback signal, a positive input terminal of the comparator being electrically coupled to receive the protection command signal, and an output terminal of the comparator being for outputting the comparing result signal.

7. The backlight module according to claim 1, wherein the analog dimming signal or the digital dimming signal is generated in response to an automatically adjustment of a light sensor in the liquid crystal display device.

8. The backlight module according to claim 1, wherein the analog dimming signal or the digital dimming signal is generated in response to a manual adjustment of an user.

9. A backlight module applied to a liquid crystal display device, the back light module comprising:

a control circuit for outputting a driving signal according to an analog dimming signal or a digital dimming signal;

a driving circuit, electrically coupled to the control circuit, for receiving the driving signal and thereby outputting a lamp voltage according to the received driving signal;

a fluorescent lamp set, electrically coupled to the driving circuit and comprising a plurality of fluorescent lamps, for receiving the lamp voltage and thereby producing a lamp current;

a lamp feedback circuit, electrically coupled to the driving circuit, for obtaining the lamp voltage and outputting a feedback signal according to the obtained lamp voltage; and a dynamic protection circuit, electrically coupled between the lamp feedback circuit and the control circuit, for dynamically adjusting a protection command signal according to the analog dimming signal or the digital dimming signal, comparing the protection command signal and the feedback signal, and thereby generating a comparing result signal to the control circuit, wherein, the dynamic protection circuit comprises:

a square wave to direct current level adjustment circuit, for receiving the digital dimming signal and thereby adjusting the protection command signal; and a comparing circuit, electrically coupled to the square wave to direct current level adjustment circuit, for receiving the adjusted protection command signal and the feedback signal and thereby outputting the comparing result signal.

10. The backlight circuit according to claim 9, wherein the square wave to direct current level adjustment circuit comprises:

a fourth resistor, wherein a first terminal of the fourth resistor is electrically coupled to receive the digital dimming signal;

a first transistor, wherein a base terminal of the first transistor is electrically coupled to a second terminal of the fourth resistor, a collector terminal of the first transistor is electrically coupled to a positive power source terminal;

a fifth resistor, wherein a first terminal of the fifth resistor is electrically coupled to an emitter terminal of the first transistor;

a sixth resistor, wherein a first terminal of the sixth resistor is grounded; and a second capacitor, wherein a first terminal of the second capacitor is electrically coupled to the emitter terminal of the first transistor, and a second terminal of the second capacitor is grounded;

wherein a second terminal of the fifth resistor and a second terminal of the sixth resistor are electrically coupled together for outputting the adjusted protection command signal.

* * * * *